United States Patent [19]

Uzawa et al.

[11] Patent Number: 4,652,157

[45] Date of Patent: Mar. 24, 1987

[54] PRINTING WIRE

[75] Inventors: Sumiyo Uzawa, Tokyo; Tetsuo Fujiwara, Yokohama; Isao Suzuki, Kimitsu; Akira Endo, Zama, all of Japan

[73] Assignee: Kabushiki Kaisha Toshiba, Kawasaki, Japan

[21] Appl. No.: 681,210

[22] Filed: Dec. 13, 1984

[30] Foreign Application Priority Data

Dec. 21, 1983 [JP] Japan ..... 58-239799
Sep. 7, 1984 [JP] Japan ..... 59-187807

[51] Int. Cl.[4] ..... B41J 3/10

[52] U.S. Cl. ..... 400/124; 101/93.05; 420/441

[58] Field of Search ..... 101/93.05; 400/124; 75/238; 420/417, 430, 431, 435, 441

[56] References Cited

U.S. PATENT DOCUMENTS 3,045,334 7/1962 Berezins ..... 420/441 X
4,330,333 5/1982 Gibbs ..... 75/238 X
4,514,224 4/1985 Nishigaki ..... 75/238

FOREIGN PATENT DOCUMENTS 51-30513 3/1976 Japan .
0011802 1/1980 Japan ..... 400/124
459854 1/1937 United Kingdom ..... 420/431

OTHER PUBLICATIONS

IBM Technical Disclosure Bulletin, "Print Wire for Wire Matrix Printer", by Travieso, vol. 25, No. 8, Jan. 83, p. 4270.

*Primary Examiner*—Edgar S. Burr
*Assistant Examiner*—David A. Wiecking
*Attorney, Agent, or Firm*—Oblon, Fisher, Spivak, McClelland & Maier

[57] ABSTRACT

A printing wire comprises a wire main body made of a sintered super hard alloy containing a hard alloy powder, whose major constituent is carbide powder, and a binder phase comprising at least one element selected from the group consisting of nickel and cobalt; and an alloy layer formed on the entire surface of the wire main body, which contains nickel as a major constituent and has nickel phosphide or nickel boride precipitated therein, or an alloy layer which contains cobalt as a major constituent and has cobalt phosphide or cobalt boride precipitated therein.

13 Claims, 3 Drawing Figures

PRINTING WIRE

BACKGROUND OF THE INVENTION

The present invention relates to a printing wire and, more particularly, to a printing wire used for a wire dot printer.

Various systems have been proposed for printers as output devices for office equipment such as word-processors. Among these printers, a wire dot printer has been in widespread use since a special head is not required.

A conventional wire dot printer is shown in FIG. 1. Referring to FIG. 1, reference numeral 1 denotes a head case having leaf springs 3 fixed by bolts 2. The case 1 comprises a cylindrical member integral with a ring-like plate. A plurality of armatures 4 are arranged in the head case 1. Only two armatures 4 are shown in FIG. 1. One end of each of the armatures 4 is fixed by a corresponding leaf spring 3, and the other end of the armature 4 constitutes a free end. The free end of the armature 4 is fixed with a printing wire 6 having a striking portion at its distal end. The printing wire 6 is fitted in a guide hole 8 of a guide plate 7 and is guided. The guide plate 7 is fixed by a bolt on the head case 1. Electromagnets 9 are disposed in the head case 1 immediately under the corresponding armatures 4.

In this wire dot printer, an electromagnet 9 is turned on/off to vertically move the corresponding armature 4. Upon vertical movement of the armature 4, a corresponding striking portion 5 of the printing wire 6 extends outside from the head case 1 and transfers a color medium such as ink from an ink ribbon to a recording sheet on a platen (not shown). More particularly, when the electromagnet 9 is selectively turned on, the corresponding armature 4 is attracted to the electromagnet 9, and the printing wire 6 strikes a printing medium. However, when the electromagnet 9 is turned off, the corresponding armature 4 returns to an initial position by means of the corresponding leaf spring 3. In the conventional wire dot printer having the construction described above, the printing wire slides along the ink ribbon at a time of printing, and the printing wire must have high wear resistance.

A conventional printing wire comprises a tungsten carbide wire. Such a printing wire has high wear resistance, but is brittle when bent. The printing wire is easily damaged by careless handling, by rough surfaces on the recording sheet or the printing medium, resulting in inconvenience.

A titanium carbide wire has been developed to decrease the weight of a printer. However, the titanium carbide printing wire is also brittle when bent. In addition, the wire can be easily damaged by careless handling and by rough surfaces on the recording sheet and the printing medium. For these reasons, light-weight titanium carbide wire cannot be sufficiently utilized.

SUMMARY OF THE INVENTION

It is an object of the present invention to provide a wear-resistant high-strength printing wire.

It is another object of the present invention to provide a wear-resistant, high-strength and light-weight printing wire.

In order to achieve the above objects of the present invention, there is provided a printing wire comprising:

a wire main body made of a sintered super hard alloy, the sintered super hard alloy containing a hard alloy powder as a major constituent and a binder phase of at least one of nickel and cobalt; and an alloy layer, formed on an entire surface of the wire main body, contains nickel as a major constituent and has nickel phosphide or nickel boride precipitated therein, or an alloy layer containing cobalt as a major constituent and having cobalt phosphide or cobalt boride precipitated therein.

The hard alloy powder constituting the sintered super hard alloy improves hardness and wear resistance. The hard alloy powder comprises tungsten carbide powder, titanium carbide powder, or a powder mixture of titanium carbide powder and at least one material selected from the group consisting of titanium nitride powder, tantalum carbide powder, and molybdenum carbide powder. In particular, a sintered super hard alloy having titanium carbide powder is effective in decreasing the weight of the printing wire. In this case, a powder mixture, being very hard and having high wear resistance, must be used.

A binder phase of one of nickel and cobalt is a component which prevents wetting with hard alloy powder and particle growth and which contributes to improve the sintering property. The binder phase preferably comprises cobalt or a nickel-cobalt alloy when the carbide powder comprises tungsten carbide powder. In particular, in order to improve the hardness and anti-oxidation property of the Ni-Co alloy in a solid phase reaction ($\alpha \rightleftarrows \epsilon'$) in a binary alloy state, an alloy containing 35% by weight or less of nickel, practically 5 to 35% by weight of nickel is preferably used. The content of this binder phase in the sintered super hard alloy preferably falls within a range between 10% by weight and 30% by weight. When the content of the binder phase becomes less than 10% by weight, the hard alloy powder cannot be properly sintered. However, when the content exceeds 30% by weight, toughness is improved, but hardness is degraded. As a result, the wear resistance of the printing wire cannot be improved. On the other hand, when titanium carbide powder or a powder mixture is used as a hard alloy powder, a binder phase comprises nickel or an alloy of nickel and at least one element selected from the group consisting of cobalt, chromium and molybdenum. The content of the binder phase in the sintered super hard alloy is preferably 20 to 50% by weight. When the content of the binder phase becomes less than 20% by weight, the hard alloy powder cannot be sufficiently sintered. However, when the content exceeds 50% by weight, toughness of the sintered super hard alloy is increased, but its hardness is decreased. As a result, wear resistance of the printing wire cannot be improved.

The alloy layer formed on the entire surface of the wire main body made of the sintered super hard alloy provides high toughness without reducing hardness. Such an alloy layer comprises an alloy containing nickel as a major constituent and having a nickel boride such as $Ni_2B$ and $Ni_3B_2$ or a nickel phosphide such as $Ni_3P$ precipitated therein. The alloy layer may comprise an alloy containing cobalt as a major constituent and having a cobalt boride such as $Co_2B$ or a cobalt phosphide such as $Co_2P$ precipitated therein. The alloy layer is formed such that a plated layer containing Ni, B and P or a plated layer containing Co, B and P is formed on the entire surface of the wire main body and that the resultant structure is properly heated. The alloy may be formed by dispersion plating in such a manner that nickel boride or nickel phosphide or cobalt boride or cobalt phosphide is dispersed.

In order to improve adhesion between the wire main body made of the sintered super hard alloy and the alloy layer of the printing wire according to the present invention, nickel or cobalt as the major constituent of the alloy layer is diffused to form a diffusion layer at the interface between the wire main body and the alloy layer, and the diffusion layer is bounded to the binder phase of the sintered super hard alloy of the wire main body. In the printing wire having the construction described above, the plated layer is formed on the entire surface of the wire main body and is heated. The process for fabricating the printing wire will be described with reference to FIGS. 2A and 2B.

Referring to FIG. 2A, an Ni-B layer 12 is plated by an electroless plating solution containing, for example, Ni and B, on the surface of a wire main body 11 made of a sintered super hard alloy. The resultant structure is heated in a nonoxidizing atmosphere. In this case, the layer 12 is amorphous before a heat treatment is performed. However, the layer 12 is heated and converted to an alloy. As shown in FIG. 2B, nickel boride is precipitated (as a eutectic crystal 14 of Ni—$Ni_3B$) in the Ni layer 13, thereby obtaining an alloy layer 15. At the same time, Ni is diffused from the alloy layer 15 in a binder phase constituting the sintered super hard alloy of the wire main body 11, thereby forming a diffusion layer 16 at the interface between the wire main body 11 and the alloy layer 15. This heat treatment is preferably performed in a nonoxidizing atmosphere at a temperature of 300° to 900° C. for 1 to 20 hours. When heating is performed at an excessively high temperature and an excessively long time, various carbonates of hard alloy powder are decarburized, which results in brittleness. However, when the heat treatment is performed at a low temperature, alloying and diffusion cannot be sufficiently performed. In the heat treatment, the diffusion can be performed and hydrogen gas adsorbed in the plated layer can be removed. Therefore, adhesion between the alloy layer and the wire main body is improved. A thickness of the plated layer is preferably 2 to 30% of a diameter of the wire main body made of the sintered super hard alloy. When the thickness of the plated layer is excessively decreased, an alloy layer having a sufficient thickness cannot be obtained during the heat treatment. However, when the thickness of the plated layer is excessively increased, good adhesion between the alloy layer and the wire main body cannot be obtained. Taking diffusion into consideration during the heat treatment, the thickness of the plated layer is preferably more than 3 μm.

DETAILED DESCRIPTION OF THE PREFERRED EMBODIMENT

Figure 1:
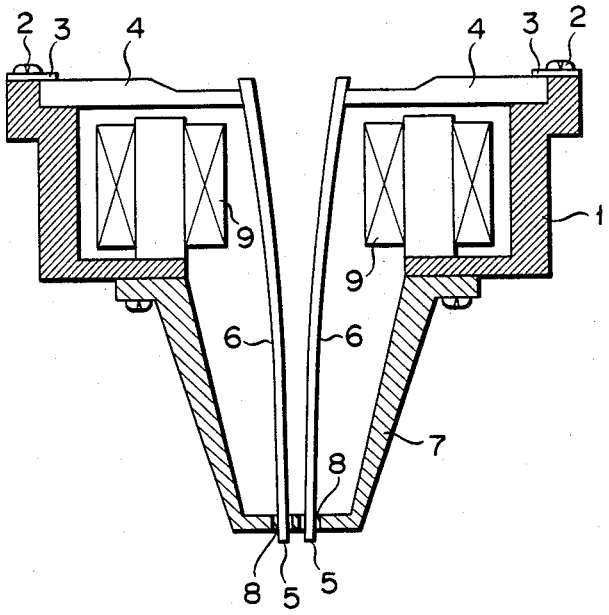
FIG. 1 is a sectional view of a wire dot printer.
Figure 2A:
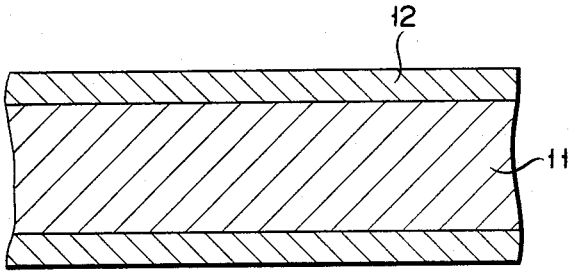
FIGS. 2A and 2B are sectional views for explaining the steps in manufacturing the printing wire.
Figure 2B:
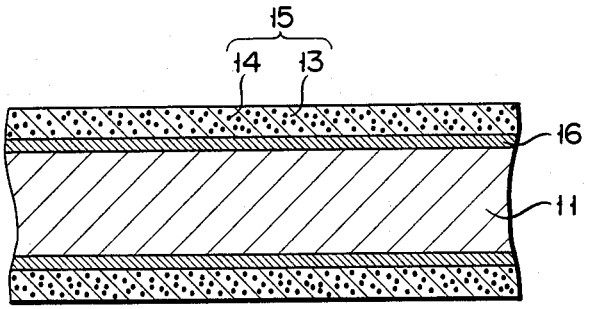

The present invention will be described in detail by way of examples.

EXAMPLE 1

A sintered super hard alloy material consisting of 84% by weight of tungsten carbide (WC) having an average particle size of 3 to 5 μm and 16% by weight of cobalt (Co) powder having an average particle size of 2 to 3 μm was mixed and milled for 80 hours in a wet ball mill. 1 to 1.5% by weight of paraffin (melting point of 45° C.) was added as a molding accelerator in the mixture to prepare a kneaded material. The kneaded material was molded into a wire at a pressure of 2 tons/$cm^2$. Paraffin was removed from the molded body in a hydrogen gas-free atmosphere at a temperature of 700° C. for one hour, thereby preparing a presintered body. The presintered body was placed in a vacuum furnace and was heated at a heating rate of 300° C./hr and was kept at a temperature of 1,200° to 1,900° C. for one hour. In this manner, a sintered super hard alloy wire main body having a diameter of 0.3 mm was prepared.

The wire main body was degreased and was dipped in a 1% stannous chloride solution and 0.1% palladium chloride solution for 1 minute, thereby activating the surface of the wire main body. The activated wire main body was dipped in an Ni-B electroless plating solution containing 30 g/l of nickel sulfate, 50 g/l of potassium citrate and 5 g/l of diethylaminoboron. The main body was plated at a temperature of 75° to 80° C. for 2 hours, while the concentration of the solution was kept uniform. An Ni-B plated layer having a thickness of about 15 μm was formed on the entire surface of the wire main body. Thereafter, the resultant structure was annealed in a vacuum state at a temperature of 800° C. for 2 hours, thereby preparing a printing wire.

It was found that an alloy layer having nickel as a major constituent and a boride precipitated therein was formed on the surface of the wire main body, and that a diffusion layer bonded to the Ni binder phase of the sintered super hard alloy of the main body was formed at the interface between the main body and the alloy layer.

EXAMPLE 2

A wire main body prepared in the same manner as in Example 1 was degreased and was dipped in a 1% stannous chloride solution and a 0.1% palladium chloride solution for one minute, thereby activating the surface of the wire main body. The activated wire main body was dipped in an Ni-B electroless plating solution containing 30 g/l of nickel sulfate, 50 g/l of potassium citrate, 5 g/l of diethylaminoboron and 150 g/l of $Ni_2B$ powder having an average particle size of 3 to 5 μm. The wire main body was plated in this solution at a temperature of 75° to 80° C. for 2 hours while the concentration of the solution was kept constant. As a result, an Ni-B plated layer (alloy layer) in which $Ni_2B$ was dispersed and precipitated was formed on the entire surface of the wire main body to a thickness of about 15 μm, thereby preparing a printing wire.

Transverse rupture strengths (TRS) of the printing wires in Examples 1 and 2 were measured complying with JIS H-5501. The transverse rupture strength of the printing wire in Example 1 was 708 kg/$mm^2$. However, the TRS of the printing wire (Example 2) having no diffusion layer between the wire main body and the alloy layer was 614 kg/$mm^2$. A printing wire (Control 1) made of only a sintered super hard alloy, having no alloy layer and obtained in the same manner as in Example 1 had a TRS of 509 kg/$mm^2$.

The printing wires in Example 1 and Control 1 were built into the wire dot printer shown in FIG. 1, and the striking frequencies of these printing wires were measured until they were ruptured. The printing wire in Example 1 could withstand striking 3 billion times, while the printing wire in Control 1 could withstand striking 2.5 billion times. As a result, the printing wire in Control 1 had a shorter service life.

EXAMPLES 3-5

Three types of wire main bodies were prepared in the same manner as in Example 1, except that WC powder having an average particle size of 3 to 5 μm, Co powder having an average particle size of 2 to 3 μm and Ni powder having the same average particle size as that of Co powder were weighed to obtain compositions shown in Table 1.

The respective wire main bodies were activated in the same manner as in Example 1. An Ni-B plated layer having a thickness of 15 μm was formed on each of the entire surfaces of the respective wire main bodies in the same Ni-B electrolytic solution as in Example 1. Thereafter, the resultant structures were heated in an electric furnace in a vacuum atmosphere at a temperature of 600° C., thereby alloying Ni and B, and precipitating and dispersing a boride. As a result, three types of printing wires were prepared.

EXAMPLES 6-8

The same wire main bodies as in Examples 3 to 5 were activated in the same manner as in Example 1. The activated wire main bodies were dipped in an Ni-B electroless plating dispersion solution containing 30 g/l of nickel sulfate, 50 g/l of potassium citrate, 5 g/l of diethylaminoboron, and 150 g/l of $Ni_2B$ powder having an average particle size of 3 to 5 μm. The wire main bodies were plated at a temperature of 75° to 80° C. for 2 hours while the concentration of the solution was kept uniform. As a result, an Ni-B plated layer (alloy layer) in which $Ni_2B$ was dispersed and precipitated and had a thickness of 15 μm was formed on each of the entire surfaces of the wire main bodies, and three types of printing wires were prepared.

The TRS measurement was performed for the printing wires obtained in Examples 3 to 8 in the same manner as in Example 1. The results were summarized in Table 1. In Table 1, the printing wires respectively made of only sintered super hard alloys in Examples 3 to 5 were given as Controls 2 to 4.

TABLE 1

| | Composition of wire main body (wt %) | | | Presence/ absence of alloy layer | Presence/ absence of diffusion layer | Transverse rupture strength (TRS) ($kg/mm^2$) |
|---|---|---|---|---|---|---|
| | WC | Co | Ni | | | |
| Example 3 | 75 | 17 | 8 | Present | Present | 780 |
| Example 6 | 75 | 17 | 8 | Present | Absent | 650 |
| Control 2 | 75 | 17 | 8 | Absent | Absent | 580 |
| Example 4 | 90 | 8 | 2 | Present | Present | 720 |
| Example 7 | 90 | 8 | 2 | Present | Absent | 614 |
| Control 3 | 90 | 8 | 2 | Absent | Absent | 530 |
| Example 5 | 80 | 18 | 2 | Present | Present | 755 |
| Example 8 | 80 | 18 | 2 | Present | Absent | 630 |
| Control 4 | 80 | 18 | 2 | Absent | Absent | 560 |

As is apparent from Table 1, the printing wires (Examples 6 to 8) having the alloy layers in which $Ni_2B$ was precipitated had higher TRS than the conventional printing wire made of only a sintered super hard alloy. In addition, the printing wires (Examples 3 to 5) each having the diffusion layer between the wire main body and the alloy layer had higher TRS than the printing wires (Examples 6 to 8). In particular, when the printing wires in Examples 3 to 5 were built into the wire dot printer shown in FIG. 1 and were subjected to measurement of the striking frequency before rupture (service life), they had the same service life as that in Example 1.

EXAMPLE 9

A wire main body having the same composition as in Example 1 was activated and was dipped in an electroless plating solution of the composition below. This wire main body was plated at a temperature of 65° to 70° C. for 2 hours, thereby forming a plated layer having a thickness of 15 μm thereon.

| (Ni—P Electroless Plating Solution) | |
|---|---|
| Nickel sulfate | 30 g/l |
| Sodium hypophosphite | 10 g/l |
| Sodium acetate | 10 g/l |

The wire main body having the plated layer thereon was annealed in a vacuum atmosphere at a temperature of 600° C. for 2 hours, thereby alloying the plated layer, and causing the plated layer to be subjected to precipitation and diffusion, thereby obtaining the printing wire.

EXAMPLE 10

A wire main body having the same composition as in Example 1 was activated and was dipped in an electroless plating solution of the composition below. This wire main body was plated at a temperature of 65° to 70° C. for 2 hours, thereby forming a plated layer (alloy layer) having a thickness of 15 μm thereon, and $Ni_3Pn$ dispersed and precipitated therein, and hence a printing wire.

| (Ni—P Electroless Plating Solution) | |
|---|---|
| Nickel sulfate | 30 g/l |
| Sodium hypophosphite | 10 g/l |
| Sodium acetate | 10 g/l |
| $Ni_3P$ powder having an average particle size of 3 to 5 μm | 150 g/l |

EXAMPLE 11

A wire main body having the same composition as in Example 1 was activated and was dipped in an electroless plating solution of the composition below. This wire main body was plated at a temperature of 85° to 90° C. for 1 hour, thereby forming a plated layer (alloy layer) having a thickness of 15 μm thereon.

| (Co—B Electroless Plating Solution) | |
|---|---|
| Cobalt sulfate | 51 g/l |
| Sodium hypophosphite | 24 g/l |
| Sodium citrate | 48 g/l |
| Boric acid | 31 g/l |
| Ammonium sulfate | 79 g/l |

The wire main body having the plated layer thereon was annealed in a vacuum atmosphere at a temperature of 600° C. for 2 hours, thereby alloying the plated layer, and causing the plated layer to be subjected to presipitation and diffusion, thereby obtaining the printing wire.

EXAMPLE 12

A wire main body having the same composition as in Example 1 was activated and was dipped in an electroless plating solution of the composition below. This wire main body was plated at a temperature of 85° to 90° C. for 1 hour, thereby forming a plated layer (alloy layer) having a thickness of 15 μm thereon and $CO_2B$ dispersed and precipitated therein, and hence a printing wire.

| (Co—B Electroless Plating Solution) | |
|---|---|
| Cobalt sulfate | 51 g/l |
| Sodium hypophosphite | 24 g/l |
| Sodium citrate | 48 g/l |
| Boric acid | 31 g/l |
| Ammonium sulfate | 79 g/l |
| $Co_2B$ powder having an average particle size of 3 to 5 μm | 150 g/l |

The TRS test was performed for the printing wires in Examples 9 to 12. The results were summarized in Table 2. The printing wire made of only the same sintered super hard alloy as in Example 1 was listed as Control 1.

TABLE 2

| | Type of plating solution | Presence/ absence of alloy layer | Presence/ absence of diffusion layer | Transverse rupture strength (TRS) (kg/mm²) |
|---|---|---|---|---|
| Example 9 | Ni—P electroless plating solution | Present | Present | 697 |
| Example 10 | Ni—P electroless plating dispersion | Present | Absent | 585 |
| Example 11 | Co—B electroless plating solution | Present | Present | 743 |
| Example 12 | Co—B electroless dispersion plating solution | Present | Absent | 631 |
| Control 1 | — | Absent | Absent | 509 |

As is apparent from Table 2, the printing wires (Examples 10 and 12) each having the alloy layer in which a phosphide or boride was precipitated had a higher TRS than that of the printing wire made of only the conventional sintered super hard alloy. In addition, the printing wires (Examples 9 and 11) each having the diffusion layer between the wire main body and the alloy layer had a higher TRS than the printing wires in Examples 10 and 12. In particular, the printing wires in Examples 9 and 11 were built into a wire dot printer shown in FIG. 1 and were subjected to measurement of striking frequency before rupture (service life). The printing wires in Examples 9 and 11 had the same serve life as in Example 1.

EXAMPLE 13

A sintered super hard alloy material containing 35% by weight of titanium carbide (TiC) powder having an average particle size of 3 to 5 μm, 10% by weight of titanium nitride (TiN) powder, 20% by weight of molybdenum carbide ($Mo_2C$) powder and 35% by weight of nickel (Ni) powder having an average particle size of 2 to 3 μm and serving as a binder phase were mixed and milled in a wet ball mill for 80 hours. 1 to 1.5% by weight of paraffin (melting point of 45° C.) was added as a molding accelerator in the mixture to prepare a kneaded material. The kneaded material was molded into a wire at a pressure of 2 tons/cm². Paraffin was removed from the molded body in a hydrogen gas-free atmosphere at a temperature of 700° C. for one hour, thereby preparing a presintered body. The presintered body was placed in a vacuum furnace and was heated at a heating rate of 300° C./hr and was kept at a temperature of 1,200° to 1,900° C. for one hour. In this manner, a sintered super hard alloy wire main body having a diameter of 0.3 mm was prepared.

The wire main body was degreased and was dipped in a 1% stannous chloride solution and 0.1% palladium chloride solution, thereby activating the surface of the wire main body. The activated wire main body was dipped in an Ni-B electroless plating solution containing 30 g/l of nickel sulfate, 50 g/l of potassium citrate and 5 g/l of diethylaminoboron. The main body was plated at a temperature of 75° to 80° C. for 2 hours while the concentration of the solution was kept uniform. An Ni-B plated layer having a thickness of about 15 μm was formed on the entire surface of the wire main body. Thereafter, the resultant structure was annealed in a vacuum at a temperature of 800° C. for 2 hours, thereby preparing a printing wire.

It was found that an alloy layer having nickel as a major constituent and a boride precipitated therein was formed on the surface of the wire main body, and that a diffusion layer bonded on the Ni binder phase of the sintered super hard alloy of the main body was formed at the interface between the main body and the alloy layer.

EXAMPLE 14

A wire main body prepared in the same manner as in Example 13 was degreased and was dipped in a 1% stannous chloride solution and a 0.1% palladium chloride solution for one minute, thereby activating the surface of the wire main body. The activated wire main body was dipped in an Ni-B electroless plating solution containing 30 g/l of nickel sulfate, 50 g/l of potassium citrate, 5 g/l of diethylaminoboron and 150 g/l of $Ni_2B$ powder having an average particle size of 3 to 5 μm. The wire main body was plated at a temperature of 75° to 80° 1 C. for 2 hours while the concentration of the solution was kept constant. As a result, an Ni-B plated layer (alloy layer) in which $Ni_2B$ was dispersed and precipitated was formed on the entire surface of the wire main body to a thickness of about 15 μm, thereby preparing a printing wire.

Transverse rupture strengths (TRS) of the printing wires in Examples 13 and 14 were measured complying with JIS H-5501 in the same manner as in Example 1. The transverse rupture strength of the printing wire in Example 13 was 435 kg/mm². However, the TRS of the printing wire (Example 14) having no diffusion layer between the wire main body and the alloy layer was 310 kg/mm². A printing wire (Control 5) made of only a sintered super hard alloy, having no alloy layer and obtained in the same manner as in Example 1 had TRS of 300 kg/mm². Although the TRS of the printing wires of Examples 13 and 14 was lower than that of the printing wire of Example 1, they were lighter than the printing wire of Example 1.

The printing wires in Example 13 and Control 5 were built into the wire dot printer shown in FIG. 1, and the striking frequencies of these printing wires were measured until they were ruptured. The printing wire in Example 13 could withstand striking 2 billion times, while the printing wire in Control 5 could withstand striking 1.7 billion times. As a result, the printing wire in Control 5 had a shorter service life.

EXAMPLES 15–17

Three types of wire main bodies were prepared in the same manner as in Example 13, except that TiC powder having an average particle size of 3 to 5 μm, tantalum carbide (TaC) powder, TiN powder, $Mo_2N$ powder, Co powder having an average particle size of 2 to 3 μm, Ni powder having the same average particle size as that of Co powder and the chromium (Cr) powder having the same average particle size as that of the Co powder were weighed to obtain compositions shown in Table 3.

The respective wire main bodies were activated in the same manner as in Example 13. An Ni-B plated layer having a thickness of 15 μm was formed on each of the entire surfaces of the respective wire main bodies in the same Ni-B electrolytic solution as in Example 13. Thereafter, the resultant structures were heated in an electric furnace in a vacuum atmosphere at a temperature of 600° C., thereby alloying Ni and B, and precipitating a boride and diffusing a nickel. As a result, three types of printing wires were prepared.

EXAMPLES 18–20

The same wire main bodies as in Examples 15 to 17 were activated in the same manner as in Example 13. The activated wire main bodies were dipped in an Ni-B electroless plating dispersion solution containing 30 g/l of nickel sulfate, 50 g/l of potassium citrate, 5 g/l of diethylaminoboron, and 150 g/l of $Ni_2B$ powder having an average particle size of 3 to 5 μm. The wire main bodies were plated in this solution at a temperature of 75° to 80° C. for 2 hours while the concentration of the solution was kept uniform. As a result, an Ni-B plated layer (alloy layer), in which $Ni_2B$ was dispersed and precipitated to have a thickness of 15 μm, was formed on each of the entire surfaces of the wire main bodies, and three types of printing wires were prepared.

The TRS measurement was performed for the printing wires obtained in Examples 15 to 20 in the same manner as in Example 13. The results were summarized in Table 3. In Table 3, the printing wires respectively made of only sintered super hard alloy in Examples 15 to 17 were given as Controls 6 to 8.

TABLE 3

| | Composition of wire main body (wt %) | | | | | | | Presence/ absence of alloy layer | Presence/ absence of diffusion layer | Transverse rupture strength (TRS) ($kg/mm^2$) |
|---|---|---|---|---|---|---|---|---|---|---|
| | TiC | TaC | TiN | $Mo_2N$ | Ni | Co | Cr | | | |
| Example 15 | 50 | — | — | — | 30 | 10 | 10 | Present | Present | 250 |
| Example 18 | 50 | — | — | — | 30 | 10 | 10 | Present | Absent | 190 |
| Control 6 | 50 | — | — | — | 30 | 10 | 10 | Absent | Absent | 180 |
| Example 16 | 50 | 10 | — | — | 32 | — | 8 | Present | Present | 238 |
| Example 19 | 50 | 10 | — | — | 32 | — | 8 | Present | Absent | 165 |
| Control 7 | 50 | 10 | — | — | 32 | — | 8 | Absent | Absent | 150 |
| Example 17 | 40 | — | 15 | 15 | 30 | — | — | Present | Present | 390 |
| Example 20 | 40 | — | 15 | 15 | 30 | — | — | Present | Absent | 305 |
| Control 8 | 40 | — | 15 | 15 | 30 | — | — | Absent | Absent | 290 |

As is apparent from Table 3, the printing wires (Examples 18 to 20) respectively having the alloy layers with precipitated $Ni_2B$ had higher TRS than the conventional printing wire made of only a sintered super hard alloy. In addition, the printing wires (Examples 15 to 17) each having the diffusion layer between the wire main body and the alloy layer had higher TRS than the printing wires (Examples 18 to 20). In particular, the printing wires in Examples 15 to 17 were built into the wire dot printer shown in FIG. 1 and were subjected to measurement of the striking frequency before rupture (service life). The printing wires in Examples 15 to 17 had the same service life as that in Example 13.

EXAMPLE 21

A wire main body having the same composition as in Example 13 was activated and was dipped in an electroless plating solution of the composition below. This wire main body was plated at a temperature of 65° to 70° C. for 2 hours, thereby forming a plated layer having a thickness of 15 μm thereon.

| (Ni—P Electroless Plating Solution) | |
|---|---|
| Nickel sulfate | 30 g/l |
| Sodium hypophosphite | 10 g/l |
| Sodium acetate | 10 g/l |

The wire main body having the plated layer thereon was annealed in a vacuum atmosphere at a temperature of 600° C. for 2 hours, thereby alloying the plated layer, and causing the plated layer to be subjected to precipitation and diffusion, thereby obtaining the printing wire.

EXAMPLE 22

A wire main body having the same composition as in Example 13 was activated and was dipped in an electroless plating solution of the composition below. This wire main body was plated at a temperature of 65° to 70° C. for 2 hours, thereby forming a plated layer (alloy layer) having a thickness of 15 μm thereon, and $Ni_3P$ dispersed and precipitated therein, and hence a printing wire.

| (Ni—P Electroless Plating Solution) | |
|---|---|
| Nickel sulfate | 30 g/l |
| Sodium hypophosphite | 10 g/l |
| Sodium acetate | 10 g/l |
| $Ni_3P$ powder having an average particle size of 3 to 5 μm | 150 g/l |

EXAMPLE 23

A wire main body having the same composition as in Example 13 was activated and was dipped in an electroless plating solution of the composition below. This wire main body was plated at a temperature of 85° to 90° C. for 1 hour, thereby forming a plated layer having a thickness of 15 μm thereon.

| (Co—B Electroless Plating Solution) | |
|---|---|
| Cobalt sulfate | 51 g/l |
| Sodium hypophosphite | 24 g/l |
| Sodium citrate | 48 g/l |
| Boric acid | 31 g/l |
| Ammonium sulfate | 79 g/l |

The wire main body having the plated layer thereon was annealed in a vacuum atmosphere at a temperature of 600° C. for 2 hours, thereby alloying the plated layer, causing the plated layer to be subjected to precipitation and diffusion, and obtaining the printing wire.

EXAMPLE 24

A wire main body having the same composition as in Example 13 was activated and was dipped in an electroless plating solution of the composition below. This wire main body was plated at a temperature of 85° to 90° C. for 1 hour, thereby forming a Co-B plated layer (alloy layer) having a thickness of 15 μm thereon, and $Co_2B$ dispersed and precipitated therein, and hence a printing wire.

| (Co—B Electroless Plating Solution) | |
|---|---|
| Cobalt sulfate | 51 g/l |
| Sodium hypophosphite | 24 g/l |
| Sodium citrate | 48 g/l |
| Boric acid | 31 g/l |
| Ammonium sulfate | 79 g/l |
| $Co_2B$ powder having an average particle size of 3 to 5 μm | 150 g/l |

The TRS test was performed for the printing wires in Examples 21 to 24. The results were summarized in Table 4. The printing wire made only of the same sintered super hard alloy as in Example 13 was listed as Control 5.

TABLE 4

| | Type of plating solution | Presence/ absence of alloy layer | Presence/ absence of diffusion layer | Transverse rupture strength (TRS) (kg/mm$^2$) |
|---|---|---|---|---|
| Example 21 | Ni—P electroless plating solution | Present | Present | 400 |
| Example 22 | Ni—P electroless plating dispersion | Present | Absent | 308 |
| Example 23 | Co—B electroless plating solution | Present | Present | 450 |
| Example 24 | Co—B electroless dispersion plating solution | Present | Absent | 313 |
| Control 5 | — | Absent | Absent | 300 |

As is apparent from Table 4, the printing wires (Examples 22 and 24) each having the alloy layer precipitated with a phosphide or boride had a higher TRS than that of the printing wire made of only the conventional sintered super hard alloy. In addition, the printing wires (Examples 21 and 23) each having the diffusion layer between the wire main body and the alloy layer had a higher TRS than the printing wires in Examples 22 and 24. In particular, the printing wires in Examples 21 and 23 were built into a wire dot printer shown in FIG. 1 and were subjected to measurement of striking frequency before rupture (service life). The printing wires in Examples 21 and 23 had the same service life as in Example 13.

As apparent from the above description, a very tough printing wire can be obtained, and hence a highly reliable wire dot printer can be obtained. In addition, according to the present invention, a very tough, hard, light-weight printing wire can be obtained. As a result, a highly reliable light-weight wire dot printer is obtained.

What we claim is:

1. A printing wire comprising:

a wire main body made of a sintered super hard alloy which contains a hard alloy powder, whose major constituent is a carbide powder, and a binder phase comprising at least one element selected from the group consisting of nickel and cobalt; and an alloy layer having a thickness of 2 to 30% of the diameter of the wire main body formed on the entire surface of the wire main body, the alloy layer containing nickel as a major constituent and having nickel phosphide or nickel or boride precipitated therein, or the alloy layer containing cobalt as a major constituent and having cobalt phosphide or cobalt boride precipitated therein.

2. The printing wire according to claim 1, wherein nickel or cobalt as the major constituent of the alloy layer is diffused to form a diffusion layer at an interface between the wire main body and the alloy layer, the diffusion layer being bound to the binder phase of the wire main body.

3. The printing wire according to claim 2, wherein the diffusion layer is a layer formed simultaneously with the alloy layer by heating a nickel plated layer containing phosphorus or boron, or a cobalt plated layer containing phosphorus or boron formed on the entire surface of the wire main body.

4. The printing wire according to claim 1, wherein the hard alloy powder constituting the sintered super hard alloy comprises tungsten carbide powder.

5. The printing wire according to claim 4, wherein the binder phase of the sintered super hard alloy is made of cobalt and used in an amount of 10 to 30% by weight of the sintered super hard alloy.

6. The printing wire according to claim 4, wherein the binder phase of the sintered super hard alloy is made of a nickel-cobalt alloy and used in an amount of 10 to 30% by weight, the nickel-cobalt alloy containing 5 to 35% by weight of nickel.

7. The printing wire according to claim 1, wherein the hard alloy powder constituting the sintered super hard alloy comprises titanium carbide powder.

8. The printing wire according to claim 7, wherein the binder phase of the sintered super hard alloy is made of nickel and used in an amount of 20 to 50% of the sintered super hard alloy.

9. The printing wire according to claim 7, wherein the binder phase of the sintered super hard alloy is made of an alloy formed of nickel and at least one element selected from the group consisting of cobalt, chromium and molybdenum, and used in an amount of 20 to 50% by weight of the sintered super hard alloy.

10. The printing wire according to claim 1, wherein the hard alloy powder constituting the sintered super hard alloy comprises a powder mixture of titanium carbide and at least one material selected from the group consisting of titanium nitride, tantalum carbide and molybdenum carbide.

11. The printing wire according to claim 10, wherein the hard alloy powder comprises a powder mixture of 50 to 85% by weight of titanium carbide and 15 to 50% by weight of at least one material selected from the group consisting of titanium nitride, tantalum carbide and molybdenum carbide.

12. The printing wire according to claim 10, wherein the binder phase of the sintered super hard alloy is made of nickel and used in an amount of 20 to 50% by weight of the sintered super hard alloy.

13. The printing wire according to claim 10, wherein the binder phase of the sintered super hard alloy is made of an alloy formed of nickel and at least one element selected from the group consisting of cobalt, chromium and molybdenum and used in an amount of 20 to 50% by weight of the sintered super hard alloy.

* * * * *

UNITED STATES PATENT AND TRADEMARK OFFICE

CERTIFICATE OF CORRECTION

PATENT NO. : 4,652,157

DATED : March 24, 1987

INVENTOR(S) : SUMIYO UZAWA ET AL

It is certified that error appears in the above-identified patent and that said Letters Patent is hereby corrected as shown below:

In col. 12, line 21, in claim 1, correct "nickel or boride" to read --nickel boride-- by deleting "or" after "nickel".

Signed and Sealed this

Fifth Day of September, 1989

*Attest:*

*Attesting Officer*

DONALD J. QUIGG

*Commissioner of Patents and Trademarks*